United States Patent [19]

Rätz et al.

[11] 4,104,592

[45] Aug. 1, 1978

[54] REMOTE CONTROL OF A MOBILE UNDERGROUND MACHINE, PARTICULARLY IN A MINE

[75] Inventors: Walter Rätz, Gelsenkirchen; Werner Lindemann, Essen, both of Fed. Rep. of Germany

[73] Assignee: Bergwerksverband GmbH, Essen, Fed. Rep. of Germany

[21] Appl. No.: 725,528

[22] Filed: Sep. 22, 1976

[30] Foreign Application Priority Data

Mar. 24, 1976 [DE] Fed. Rep. of Germany ..... 2612368

[51] Int. Cl.[2] ..... H04B 1/00; H04B 7/26

[52] U.S. Cl. ..... 325/37; 325/111; 325/119; 325/185; 343/225

[58] Field of Search ..... 325/28, 51, 64, 37, 325/185, 111, 117, 119, 183, 361; 340/47, 48; 343/225, 228; 246/167 R, 187 A, 187 B; 179/82; 318/16

[56] References Cited

U.S. PATENT DOCUMENTS

| | | | |
|---|---|---|---|
| 2,499,195 | 2/1950 | McNiven | 325/28 |
| 3,071,728 | 1/1963 | Grace et al. | 325/361 |
| 3,293,549 | 12/1966 | Patterson | 325/37 |
| 3,673,497 | 6/1972 | Thrasher | 325/28 |
| 3,699,578 | 10/1972 | Fiorentino | 325/37 |

*Primary Examiner*—Robert L. Griffin
*Assistant Examiner*—Jin F. Ng
*Attorney, Agent, or Firm*—Michael J. Striker

[57] ABSTRACT

The mobile machine travels underground in a mine along a predetermined path and has a stationary prime mover for driving it. A portable remote control unit is carried by the human operator outside the passenger compartment of the mobile machine, for controlling operation of the prime mover. The portable remote control unit includes a transmitting antenna. When the operator rides in the passenger compartment, he places the portable unit in a special holder therefor. A coupling circuit couples the transmitting antenna of the portable unit, when the latter is inside the passenger compartment with the operator, to an exterior transmitting antenna, so that the substantially closed passenger compartment walls will not prevent transmission of remote control signals. The signals are picked up by a receiving antenna and transmitted to a stationary control unit which correspondingly controls the operation of the prime mover.

4 Claims, 6 Drawing Figures

REMOTE CONTROL OF A MOBILE UNDERGROUND MACHINE, PARTICULARLY IN A MINE

BACKGROUND OF THE INVENTION

The invention relates to a remote control arrangement for operating a mobile underground mining machine from a portable remote control unit. The portable remote control unit includes a high-frequency transmitter for transmitting frequency-modulated audio-frequency-encoded signals. These signals are coupled by means of a ferrite antenna into a simple insulated conductor loop serving as a receiving antenna. The antenna conductor loop is electrically connected with a high-frequency receiver in a central control stage. The receiver demodulates the frequency-modulated signal, decodes the audio-frequency-encoded control signals, and applies the control signals to relay circuitry operative for controlling the operation of the underground mining machine. The control signals transmitted from the portable remote control unit are selected by means of a self-locking multi-step master switch provided with a dead-man's button for preventing inadvertent activation of the master switch. An operating switch cooperates with the master switch for readying the portable remote control unit for operation by the master switch. An emergency switch cooperates with the master switch and with the operating switch for stopping the controlled machine and deenergizing the prime mover of the underground mining machine and can be activated in the case of an emergency.

Remote control arrangements of this general type have already been used underground for the control of travelling thrust beams.

SUMMARY OF THE INVENTION

It is an object of the invention to improve upon the remote control expedient of the prior art in such a manner as to make it suitable for the control of the operation of mobile underground mining machines, for example monorail vehicles, which in the course of their travel must bridge considerably larger distances.

With such underground mining machines, the prime mover for the machine is often located at one or both ends of the path of travel of the machine. For example, in the case of a monorail conveyor, the drive motor or drive engine for the conveyor may be located at one end of the monorail track, with drive cables extending from the prime mover along the full length of the monorail track to the other end of the track and connected intermediate the ends of the track to the monorail car. In the case of such machines, it is desired according to the invention to control the travel of the machine, for example of the monorail car, from not only the ends of the track, but from any desired point along the length of the track, as well as from any desired point remote from the track.

Furthermore, it is nowadays common to provide the mobile underground mining machine with a completely closed passenger compartment in which a miner or machine operator can ride along with the machine. However, when the door to such closed passenger compartment is shut, the walls of the passenger compartment tend to prevent the transmission of remote control signals through space. As a result, if the portable remote control unit is being carried by the machine operator riding in such compartment, he may lose his ability to control the operation of the machine as he rides along with it. The invention contemplates an expedient which will ensure that the operator does not lose control of the mobile machine under such circumstances.

These objects, and others which will become more understandable from the description, below, of a preferred embodiment, can be met, according to one advantageous concept of the invention, by providing inside the portable remote control unit a U-shaped ferrite transmitting antenna, by providing in the interior of the passenger compartment of the mobile underground mining machine a holder for the portable remote control unit, by providing an external transmitting antenna on the mobile underground machine exteriorly of the passenger compartment, and by establishing the requisite coupling between the transmitting antenna of the portable unit when the latter is in the passenger compartment and the exterior transmitting antenna using a high-frequency coupling circuit, such as an inductive or mutually inductive coupling circuit, which is entirely passive and requires no active components or energy supplies for such active components.

With the inventive remote control arrangement, the stationary drives of mobile underground mining machines, such as for example monorails, can be controlled from outside the machine at any desired location along the machine travel path. The machine operator simply carries the portable remote control unit on his person or in his hands and stands or moves along the conductor loop of the receiving antenna for the stationary central control unit. This can be done at the ends of the machine travel path, particularly for example when the mobile machine is located at one of the ends of its travel path for the purpose of being loaded up or unloaded. Alternatively, however, the machine operator can enter into the passenger compartment of the mobile mining machine, insert the portable remote control unit onto the holder in the interior of the compartment, so that the remote control unit's transmitting antenna will become coupled to the external transmitting antenna on the exterior of the passenger compartment, and then proceed to control the operation of the machine from the interior of the passenger compartment as the machine moves along its travel path.

According to a preferred embodiment, the coupling of the ferrite rod exterior transmitting antenna on the exterior of the passenger compartment to the U-shaped ferrite transmitting antenna of the portable remote control unit is effected by means of a high-frequency pick-up coil serving as a receiving antenna and electrically connected to the resonant turning circuitry of the exterior ferrite rod transmitting antenna. Preferably the high-frequency pick-up coil is located in the interior of the passenger compartment of the mobile underground mining machine, and is designed in such a manner as to be securable to the housing of the portable remote control unit, to pick up most effectively the signals beings transmitted from the U-shaped ferrite transmitting antenna of the portable unit when the latter is inside the passenger compartment. In that event, wires can lead out from the high-frequency pick-up coil through the wall of the passenger compartment to the exterior ferrite rod transmitting antenna.

According to another concept of the invention, the portable remote control unit is provided with a removable energy supply unit. The energy supply unit is advantageously removable from the portable remote control unit very readily. Advantageously, the removable energy supply unit is intrinsically safeguarded against sparking such as might cause explosion, i.e., both when removed from the portable remote control unit and when in place thereon, it is explosion-safe. The energy supply unit can be comprised of a housing containing a safeguarded Ni-Cd battery with protective resistors and a reed contact. The housing of the energy supply unit can be mounted on the housing of the portable remote control unit, with plug-and-socket connections becoming established between the battery in the energy supply unit and the circuitry inside the portable remote control unit. Advantageously, the terminals of the battery in the energy supply unit are connected to the plug and socket connectors of the unit through a reed contact which does not close except under the influence of a permanent magnet provided inside the remote control unit, the magnet closing the reed contact when the energy supply unit is secured in place on the portable remote control unit.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1A:
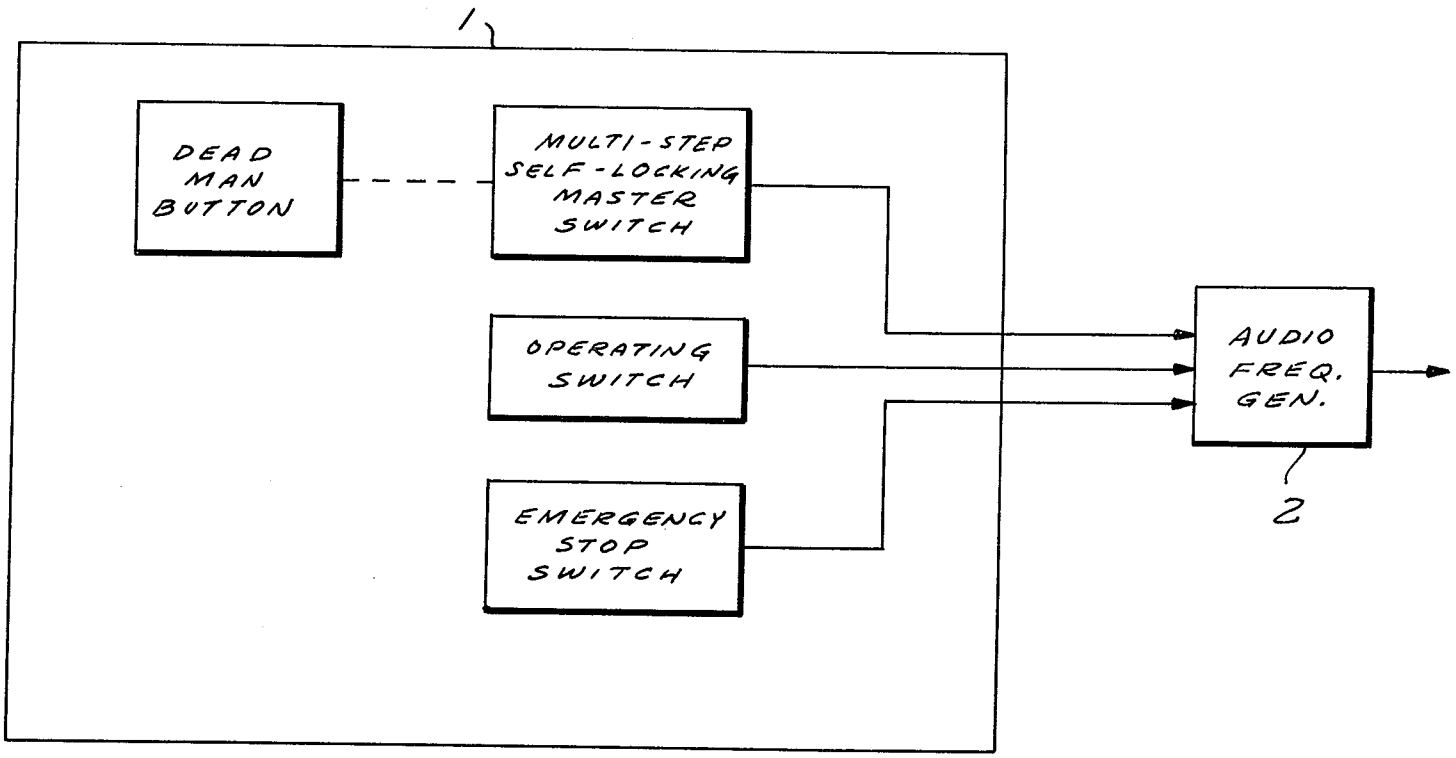
FIG. 1*a* schematically depicts the switches contained in the control switch stage 1 of the circuit of FIG. 1.
Figure 1:
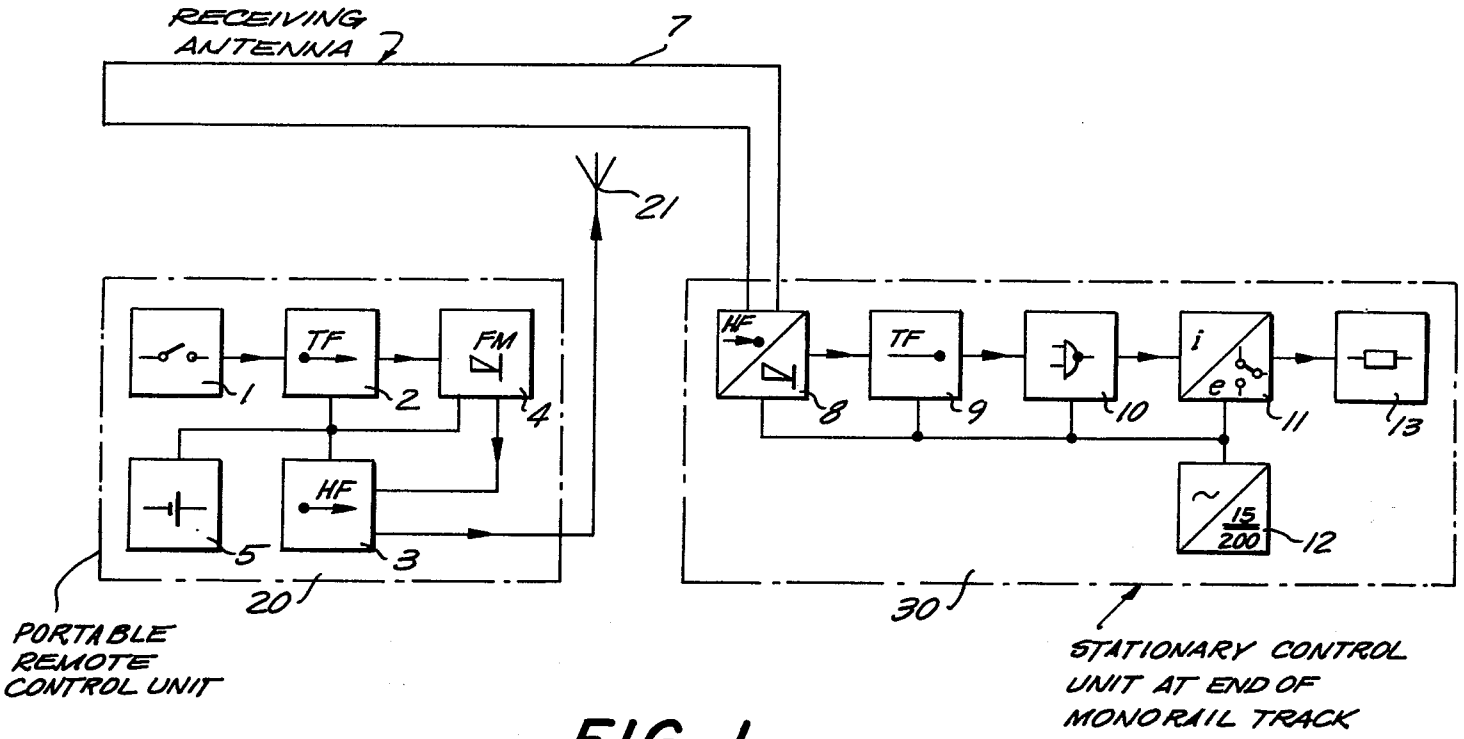
FIG. 1 is a schematic diagram of the circuitry inside the portable remote control unit and of the circuitry of the stationary central control unit.

FIG. 1 schematically depicts the circuitry inside a portable remote control unit 20 operative for controlling the operation of a mobile underground mining machine, for example a monorail conveyor which is driven through the intermediary of a drive cable by motor-driven winch located at one of the ends of the monorail track. FIG. 1 also schematically depicts the circuitry inside a stationary central control unit 30 located adjacent the motor-driven winch for controlling the operation of the mobile machine. The portable remote control unit 20 is provided with a transmitting antenna 21, whereas the stationary central control unit 30 is provided with a receiving antenna 7 for receiving the control signals from unit 20.

The portable remote control unit 20 is comprised in the illustrated embodiment of a control switch stage 1. Control switch state 1 includes (see FIG. 1*a*) a multistep master switch settable to different positions for generating different control signals to be used for the control of the monorail conveyor and car. The master switch is provided with a dead-man's button so that the control signal corresponding to the selected position will not be generated unless the dead man's button is depressed, to avoid unintentional initiation and/or continuance of machine travel. An operating switch is provided for connecting the power supply of the portable remote control unit 20 to the circuitry of unit 20. An emergency switch is also provided for causing the immediate generation of a control signal for turning off the drive motor for the drive winch to quickly stop the travel of the monrail car, e.g., without having to move the master switch through intermediate settings.

The control signals generated by the master switch in switch unit 1 are applied to an audio-frequency-signal generator stage 2. The relationship between the control signals and the audio-frequency signals generated by stage 2 is tabulated for the exemplary embodiment as follows:

| Control signal | Channels | Audio frequency (Hz) |
|---|---|---|
| forward accelerate | 8 + 7 | 2465 + 2295 |
| forward constant speed | 8 | 2465 |
| forward decelerate | 8 + 3 | 2465 + 1610 |
| stop | 1 | 1330 |
| backward decelerate | 5 + 3 | 1955 + 1610 |
| backward constant speed | 5 | 1955 |
| backward accelerate | 5 + 11 | 1955 + 2975 |
| EMERGENCY SHUT-DOWN | 1 + 3 | 1330 + 1610 |
| drive motor on | 4 | 1785 |
| drive motor off | 2 | 1470 |

These audio-frequency control signals are applied to a frequency-modulation stage 4 which modulates them onto a 190 kHz carrier. The frequency-modulated carrier is applied by stage 4 to output transmitter stage 3, which in turn applies them to a ferrite transmitting antenna 21. The frequency-modulated carrier signal is radiated out into the path of travel of the monorail. The energy required by the portable remote control unit 20 is supplied by a Ni-Cd battery 5. The FM signal is received by a conductor loop antenna 7 and transmitted from the latter to the stationary central control unit 30, which usually will be located at one of the ends of the monorail at the location of the drive motor for the drive winch. High-frequency receiver and demodulator stage 8 receives the modulated carrier and demodulates the carrier to recover the audio-frequency control signals. These are applied to an audio-frequency receiver 9. Receiver 9 applies the control signals to logic circuitry 10, which decodes the signals and routes them to appropriate control relays in a relay power stage 11. Depending upon which relays in stage 11 are energized in response to the received control signals, different output voltages will be applied to the line-up terminals 13 for the drive motor of the drive winch, so as to cause the drive motor to turn forward and accelerate, decelerate, maintain constant speed, turn backward and accelerate, decelerate, maintain constant speed, or stop. The stationary central control unit 30 is designed for the 220 and 500 volt operating voltages usually available in underground work. An suxiliary energy supply stage 12 furnishes necessary voltage magnitudes.

The conductor loop antenna 7 is comprised of low-resistance lines, for example radio conductors having a conductive cross section of a least 0.75 $mm^2$. The conductor loop antenna 7 is so laid out in the passage along which the mobile machine travels that the average spacing of the antenna from the walls of the passage amounts to at least 10 cm. Advantageously, the two runs of the antenna loop are arranged at the sides of the roof of the passage, so that the carrier of the portable remote control unit 20 will always be located in between the two runs of the antenna loop.

Figure 2:
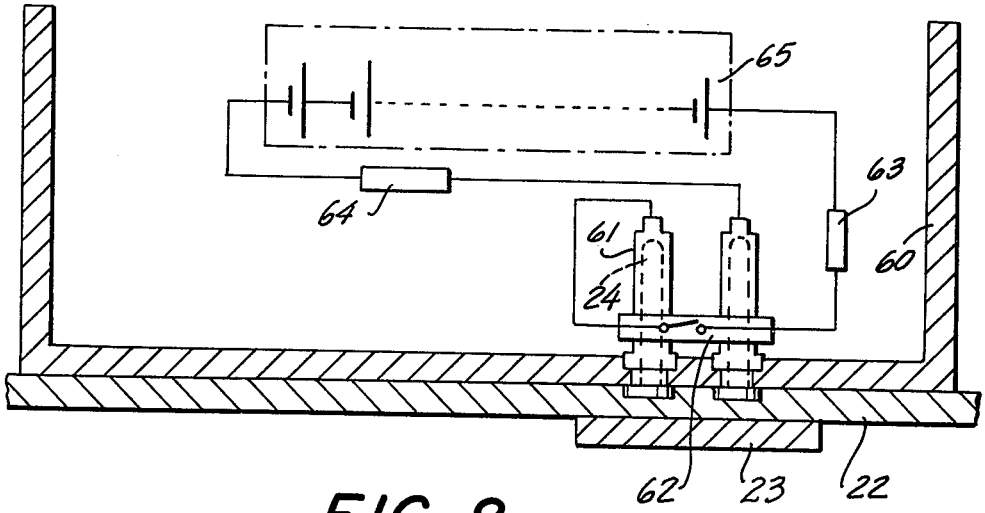
FIG. 2 depicts the energy supply unit removably mounted on the housing of the portable remote control unit.

The removable energy supply unit of the portable remote control unit 20 is depicted in FIG. 2. Numeral 22 denotes the portion of the housing of the portable remote control unit 20 onto which the removable energy supply unit is mounted. Numeral 23 denotes a permanent magnet located within the unit 20, just inward of the housing wall 22 thereof. The removable energy supply unit is comprised of a battery housing 60 which is mounted in place on the housing 22 of the portable unit 20. The housing 22 of the portable remote control unit 20 is provided with connector prongs 24 shown penetrating through openings in the wall of battery housing 60. Provided in the interior of battery housing 60 are cooperating socket connectors 61 which receive the connector prongs 24. The battery housing 60 contains the Ni-Cd battery 5 proper, as well as protective resistors 63, 64 and a reed contact 62. The reed contact 62 is so positioned as to be closed by the magnetic field from the magnet 23 inside the portable unit 20, as soon as the removable energy supply unit is mounted in place on unit 20. In this way, it is possible to exchange energy supplies underground, since with the energy supply unit removed from the unit 20 the battery terminals are not connected to voltage. The battery housing 60 is advantageously designed as a flameproof enclosure. The electrical components are all cast into one or more support components.

Figure 3:
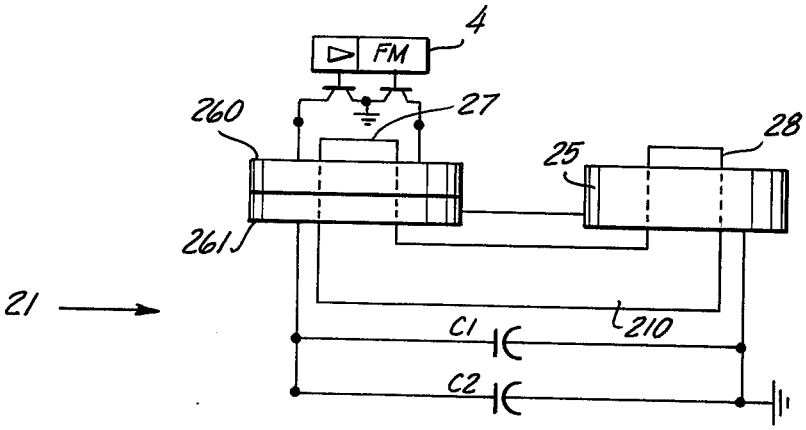
FIG. 3 schematically depicts the U-shaped ferrite transmitting antenna of the portable remote control unit.

FIG. 3 depicts details of the ferrite transmitting antenna 21 of the portable remote control unit 20. The antenna 21 is part of a resonant circuit. Antenna 21 is comprised of a U-shaped ferrite core 210 having two legs 27 and 28. Leg 27 carries the primary winding 260 and the secondary winding 261 of a transformer. The leg 28 carries an additional secondary winding 25. The two end terminals of primary winding 260 are connected across the output transistors of the transmitter stage 3, which is in turn driven by the modulator stage 4. One terminal of secondary winding 261 is joined to one terminal of secondary winding 25. The other terminal of secondary winding 261 and the other terminal of secondary winding 25 are connected by the two parallel capacitors C1, C2. The primary and secondary windings are wound with the same winding sense. By way of example, the components in question can have the following circuit values: secondary winding 25 (35 turns Cu wire, L ca. 110 $\mu$H), primary winding 260 (2 $\times$ 8 turns Cu wire, L ca. 190 $\mu$H), seconardy winding 261 (35 turns Cu wire, L ca. 110 $\mu$H), capacitor C1 (3300 pF), capacitor C2 (trimming capacitor).

Figure 4:
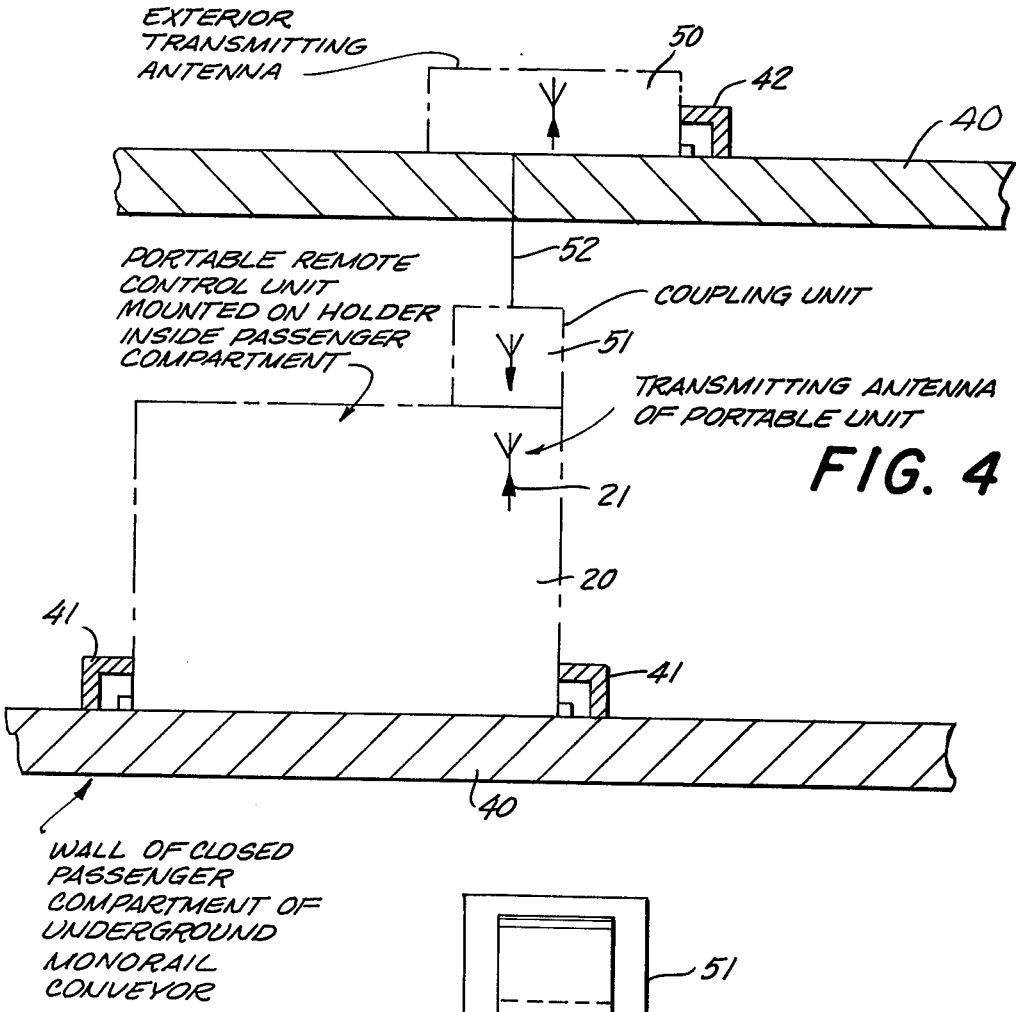
FIG. 4 schematically depicts the manner in which the transmitting antenna of the portable remote control unit, when the latter is located inside the passenger compartment of the mobile underground mining machine, is coupled to the exterior transmitting antenna of the machine.

When the monorail car and conveyor, for example, is to be operated from the outside, the person carrying the portable remote control unit 20 stands alongside its path of travel and effects the desired control operations. When the operator wishes to ride along with the machine in the interior of the passenger compartment thereof, he places the portable unit 20 on its holder 41 (see FIG. 4) in the interior of the passenger compartment. He then attaches the portable unit 20 the coupling unit 51. Coupling unit 51 is connected by means of conductors 52 to the exterior ferrite rod transmitting antenna 50 mounted on a support 42 on the exterior of the wall 40 of the passenger compartment of the machine. The coupling unit 51 could be so positioned relative to the holder 41 for portable unit 20 that, as soon as portable unit 20 is placed on holder 41, unit 51 would couple transmitting antenna 21 to exterior transmitting antenna 50. Alternatively, the coupling unit 51 could be in the form of a plug-on or otherwise designed unit which is mounted on or attached to the portable unit 20 by hand. Coupling unit 51 couples the circuitry of the exterior antenna 50 to that of the antenna 21 of portable unit 21 without any need for physical contact or electrical connection between the circuit components of the two antenna circuits.

Figure 5:
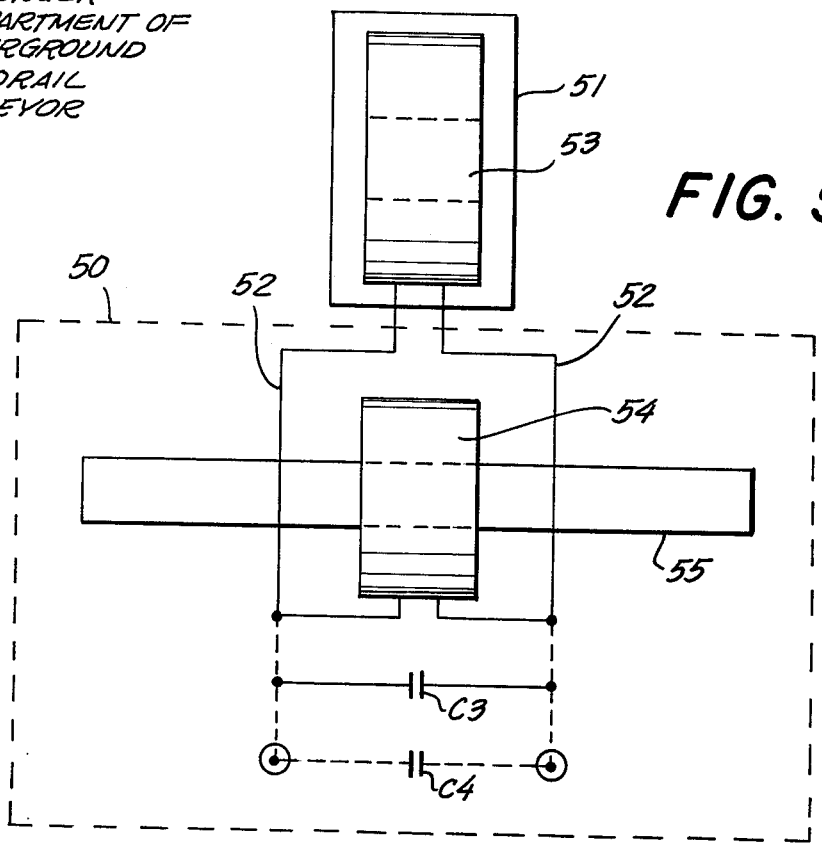
FIG. 5 shows the high-frequency pick-up coil used to couple the antenna of the portable unit to the resonant tuning circuitry of the exterior antenna of the machine.

FIG. 5 depicts details of the coupling unit 51 and of the circuitry of the exterior antenna 50. The coupling unit 51 is mainly comprised of a cast high-frequency pick-up coil 53 (L ca. 145 mH, $n$ = 35 turns, 10 + 0.1 mm $\phi$ HF-conductors). When the coupling unit 51 is properly positioned relative to the portable remote control unit 20 (whether by virtue of the positioning of the latter on the holder 41, or as a result of positive attachment by the human operator), the coil 53 acts as a receiving antenna and picks up the signal being transmitted by transmitting antenna 21. This signal is transmitted via conductors 52 to the circuitry of exterior transmitting antenna 50. The latter circuitry includes a ferrite rod 55, a coil 54 (L ca. 165 $\mu$H, $n$ = 45 turns, 10 $\times$ 0.1 mm $\phi$ HF-conductors) wound around ferrite rod 55, and connected across coil 54 the parallel connection of a capacitor C3 (3900 pF) and a capacitor C4 (trimming capacitor).

The exterior transmitting antenna 50 now transmits the frequency-modulated control signals to the conductor loop antenna 7. In the illustrated embodiment, the coupling between the interior and exterior transmitting antennas is purely high-frequency inductive, and no auxiliary supply of energy to the circuitry of the exterior transmitting antenna or to the coupling unit 50 is required.

One advantage of the U-shaped configuration of the ferrite transmitting antenna 21 of the portable control unit 20 is that it consumes considerably less space than a comparably effective ferrit rod antenna.

The coupling of the interior to the exterior antenna in the manner depicted has several advantages besides those explained above. The exterior antenna transmits the control signals more effectively than the interior antenna which latter, due to the closure of the passenger compartment for example, may be partly or even completely shielded by the passenger compartment walls in so far as transmission of control signals is concerned. The use of the high-frequency inductive coupling makes unnecessary an additional energy supply for the coupling unit or the exterior antenna. The use of inductive coupling eliminates the need for a galvanic (i.e., wire) connection between the interior and exterior transmitting antennas. The establishment of a galvanic connection might indeed be quite difficult anyway, since plug and socket connectors for signal lines carrying such high-frequency signals are not readily available.

It will be understood that each of the elements described above, or two or more together, may also find a useful application in other types of circuits and constructions differing from the types described above.

While the invention has been illustrated and described as embodied in connection with a monorail car and conveyor used underground in a mine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In combination with a mobile underground machine driven by an external stationary prime mover, the travelling underground machine having a substantially closed passenger compartment, a control arrangement therefor, the control arrangement comprising, in combination, a portable remote control unit including a multistep self-locking master switch having a plurality of settings corresponding to different control signals for the control of the prime mover and provided with a dead man's button for preventing unintentional generation of control signals, and an emergency stop switch for generating a stop signal for the prime mover, means for generating audio-frequency control signals corresponding to the settings of the master switch, means for frequency-modulating the control signals onto a high-frequency carrier, and a U-shaped ferrite transmitting antenna for transmitting the thusly modulated carrier out into space, an insulated conductor loop antenna extending along the path of travel of the mobile underground machine for receiving the thusly modulated carrier from the transmitting antenna of the portable remote control unit when the latter is being used from outside the passenger compartment of the machine; a stationary control unit electrically connected to the conductor loop antenna and including means for receiving the thusly modulated carrier signal, demodulating the latter so as to recover the control signals, decode the control signals and in dependence upon the decoded control signals correspondingly control the operation of the prime mover of the mobile underground machine; an exterior ferrite rod transmitting antenna mounted on the mobile underground machine exteriorly of the passenger compartment; a holder inside the passenger compartment for holding the portable remote control unit when the human operator of the portable remote control unit is riding in the passenger compartment of the machine; and coupling means for coupling the transmitting antenna of the portable remote control unit when the latter is inside the passenger compartment to the exterior transmitting antenna, the coupling means comprising a high-frequency coupling circuit consisting of passive circuit components not requiring a separate electrical energy supply.

2. The combination set forth in claim 1, the high-frequency coupling circuit being comprised of a high-frequency pick-up coil capable of picking up from the transmitting antenna of the portable remote control unit the modulated carrier signal being transmitted therefrom when the pick-up coil and the transmitting antenna of the portable remote control unit are properly positioned relative to each other, the exterior transmitting antenna including a resonant antenna circuit, the coupling circuit further including means galvanically connecting the pick-up coil to the antenna circuit for transmitting the picked up carrier signal thereto, the coupling means being in the form of a coupling unit which is mountable on the portable remote control unit in a predetermined position such that the pick-up coil and the transmitting antenna of the portable unit will assume said proper predetermined position relative to each other.

3. The combination set forth in claim 1, the portable remote control unit including a removable energy supply unit, the removable energy supply unit being comprised of a battery housing removably mountable on the remainder of the porable remote control unit, the battery housing including a Ni-Cd battery, protective resistors connected to the battery, plug-and-socket connectors pluggable onto the remainder of the portable remote control unit, and a reed contact, the remainder of the portable remote control unit including a magnet positioned to activate the reed contact only when the removable energy supply unit is mounted in place.

4. In combination with a mobile underground machine driven by an external stationary prime mover, the travelling underground machine having a substantially closed passenger compartment, a control arrangement therefor, the control arrangement comprising, in combination, a portable remote control unit including means for generating control signals for the control of the prime mover, and a transmitting antenna for transmitting the control signals out into space; a receiving antenna for receiving the control signals from the transmitting antenna of the portable remote control unit when the latter is being used from outside the passenger compartment of the machine; a stationary control unit electricaly connected to the receiving antenna and including means for receiving the control signals and in dependence upon the control signals corrspondingly control the operation of the prime mover of the mobile underground machine; an exterior transmitting antenna mounted on the mobile underground machine exteriorly of the passenger compartment; a holder inside the passenger compartment for holding the portable remote control unit when the human operator of the portable remote conrol unit is riding in the passenger compartment of the machine; and coupling means for coupling the transmitting antenna of the portable remote control unit when the latter is inside the passenger compartment to the exterior transmitting antenna.

* * * * *